US006332312B1

(12) United States Patent
Löscher

(10) Patent No.: US 6,332,312 B1
(45) Date of Patent: Dec. 25, 2001

(54) METHOD AND DEVICE FOR SPINNING WITH A SUPPRESSED YARN BALLOON

(75) Inventor: Rainer Löscher, Chemnitz (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/646,759

(22) PCT Filed: Sep. 30, 1999

(86) PCT No.: PCT/DE99/00965

§ 371 Date: Aug. 21, 2000

§ 102(e) Date: Aug. 21, 2000

(87) PCT Pub. No.: WO99/50488

PCT Pub. Date: Oct. 7, 1999

(30) Foreign Application Priority Data

Mar. 30, 1998 (DE) ..... 198 15 518

(51) Int. Cl.[7] ..... D01H 13/00
(52) U.S. Cl. ..... 57/354
(58) Field of Search ..... 57/200, 203, 351, 57/328, 316, 315, 317, 75, 352, 353, 248, 243, 236, 350, 354

(56) References Cited

U.S. PATENT DOCUMENTS 4,617,791 * 10/1986 Lousberg ..... 57/299
5,724,800 * 3/1998 Lucca et al. ..... 57/243

FOREIGN PATENT DOCUMENTS 882066 7/1953 (DE) .
26 53 697C2 6/1978 (DE) .
34 15 977A1 12/1984 (DE) .
34 15 998A1 12/1984 (DE) .
19514408 A1 1/1996 (DE) .
19504134 C2 8/1996 (DE) .
19526958 A1 2/1997 (DE) .
19741441 C1 10/1998 (DE) .
0 528 752 A1 2/1993 (EP) .
0 635 590 A2 1/1995 (EP) .
0 645 481 A1 3/1995 (EP) .
0 142 486 A1 5/1985 (FR) .

* cited by examiner

*Primary Examiner*—Danny Worrell
(74) *Attorney, Agent, or Firm*—Herbert Dubno

(57) ABSTRACT

The invention relates to a method and device for spinning with a suppressed yarn balloon (75), whereby the rotation of the yarn is predominately produced between a top spindle (2) and the clamping gap (523) of delivery rolls (521, 522) at the exit of the drafting system (5). The top spindle (2) is provided with one or a plurality of projecting parts in the head area thereof and extends with said projecting parts on the elongated axis of the spindle (1) from underneath up to a vertically displaceable yarn guide (3). The vertically adjustable yarn guide is displaced upwards and away from the top spindle in order to prepare an automated feed package changing. Afterwards, the ring tail (4) is lowered into the underwinding position. The aim of the invention is to provide a method which can also be used for flat and very fine yarns, especially combed yarns. To this end, the extended slubbing (71) which exits the drafting system is compacted while the yarns are maintained in a parallel position. The slubbing is guided in the clamping gap of the delivery rolls which are arranged downstream from the drafting system and at a distance therefrom.

8 Claims, 2 Drawing Sheets

METHOD AND DEVICE FOR SPINNING WITH A SUPPRESSED YARN BALLOON

CROSS REFERENCE TO RELATED APPLICATION

This application national stage of PCT/DE 99/0965 filed Mar. 26, 1999 and based upon German National Application 198 15 518.2 of Mar. 30, 1998 under the International Convention.

FIELD OF THE INVENTION

The invention relates to a process and to a device for spinning with suppressed yarn balloon whereby the rotation of the yarn is predominantly generated between a spindle attachment and the nip of supply rolls at the output of the drafting frame, whereby the spindle attachment in its head region is provided with one or more projections and with these projections the spindle extends upwardly up to a vertically adjustable thread guide on the extension of the spindle axis and whereby, preparatory to an automated bobbin change, the vertically adjustable yarn guide is displaced away from the spindle attachment upwardly and the ring rail is then lowered into the underwinding position.

BACKGROUND OF THE INVENTION

It has long been known and has been common, for the production of yarns, to utilize spinning processes in which the spindles are provided below the usually fixed thread guide with respective spinning heads. These spinning heads rotate with the spindles or in certain variants approximately with the speed of the spindles and bring the twist in the yarn relatively close to the nip of the supply rollers.

The thread balloon is thereby suppressed and the yarn can be wound up with reduced tension on the bobbin. Advantages are also obtained from the viewpoint of the travel characteristics of the traveller.

Such a process has not become widely used in practice. The reasons for this differ substantially.

The use of spinning heads results in a movement of the twist of the yarn from close to the nip of the rollers from which the slubbing is supplied to the spinning zone. The spun yarn which results is then guided via the entrainer of the spinning head in a spiral pattern from a part of the bobbin sleeve to the traveler of the spinning ring. It has been found that this spinning process gives rise to a very hairy yarn.

The use of the process is limited, therefore, to the spinning of such yarns in which the hairiness is desirable. These are yarns for carpentry, for covers or for felts (see the brochure of the Rieter firm for Carded Yarn Ring Spinning Machine H3 from the year 1967).

For the production of very fine and smooth yarn, especially combed yarn, for fabrics the hairiness of the yarn is undesirable. The spinning process with a suppressed yarn balloon is therefore not used for this purpose.

With the aim of increasing the quality of yarn spun by means of a spinning head, attempts have been made to displace the thread guide above the spinning head in a transition from balloon reduced spinning to spinning with a yarn balloon (DE 34 15 977 A1 and 34 15 998 A1). This approach has also not been crowned with success. The hairiness of the yarn by spinning with a spinning head and suppressed yarn balloon is not avoided by the displacement of the yarn guide.

For the aforementioned reasons it is preferred for the spinning of finer yarns, especially finer carded (worsted) or combed yarn, to carry out the spinning with a reduced yarn balloon with the aid of so-called balloon-limiting rings. However, increases in spinning speed and increases in the output of the spinning machine are thereby limited.

In the use of this process there has been increasing employment of so-called compaction zones in the region of the output rolls of the drafting frame (DE 882 066) or following the drafting frame (EP 0 635 590 A2 or 197 08 410 A1). These compaction zones seek to draw the fibers of the drafted slubbing into a reduced width in the nip of the supply rollers (rollers which feed the slubbing into the spinning zone). The result is a very small spinning triangle. The danger of yarn breakage is thus significantly reduced at these locations.

OBJECTS OF THE INVENTION

An object of the invention is to provide a spinning process with a spinning head and suppressed yarn balloon which is suitable for producing very fine and smooth yarn with higher reliability at higher spindle speeds and with automated bobbin change.

It is also an object of the invention to provide an apparatus for reliably carrying out the process with reduced structural cost and whereby phases between the normal spinning process and bobbin change can be effected in an optimum manner.

A method of spinning with a suppressed yarn balloon, whereby the twisting of the yarn is predominantly effected between a spindle attachment and the nip of said rollers at the output of the drafting frame, whereby the spindle attachment in its head region is provided with one or more projections and extends with these projections along the extended axis of the spindle upwardly to a vertically shiftable yarn guide, and whereby in preparation for an automated bobbin change the vertically shiftable yarn guide is moved away from the spindle attachment, is displaced upwardly and the ring rail is then lowered into the underwinding position.

According to the invention, the drafted slubbing leaving the drafting frame is compacted to maintain a parallel fiber orientation and thus is fed into the nip of the feed rollers which follow the drafting frame with a spacing.

The combination of balloonless spinning with compaction spinning gives rise to surprising results which would not have been expected by the artisan. In the spinning without a yarn balloon, higher twists in the yarn, especially in the region between the yarn guide above the spinning head and the nip of the supply rollers, are obtainable. Because of the reduced spinning triangle that results from compaction spinning, all of the fibers are oriented strictly parallel to the yarn as it is further displaced directly downstream of the nip of the supply roller pair in the spinning process. They together ensure the stability of the yarn. The resulting yarn is very smooth. The hairiness customary in such yarn is practically completely eliminated. The number of yarn breaks at the output of the supply rollers is practically zero.

With the aforementioned combination of process steps, very thin yarns can be spun in a problemless manner with higher quality.

The method, according to the invention in preparation for stopping of the spinning machine, the spindle speed is reduced by more than 50%, with the reduced spindle speed, the spacing between the yarn guide and the spindle attachment is significantly increased, and the spinning process is altered from suppressed yarn balloons spinning to spinning with a speed- determined small-yarn-balloon spinning. In preparation for the restarting of the spinning machine, the increased spacing between the yarn guide and the spindle attachment is initially maintained, at low spindle speed and during the spinning process with a yarn balloon the first turns are applied with speed controlled small yarn balloon, and then after the lowering of the thread guide against the spindle attachment, spinning with suppressed yarn balloon at normal spinning speed is carried out.

Depending on the type and manner of the change in the spinning process before and after a stopping process for the purpose of bobbin change the optimum conditions in spinning with a reduced yarn balloon and also for the process transition and for spinning with a yarn balloon without additional assistance, like controlled balloon-limiting rings, can be ensured.

The parameters according to the invention which result in further optimization of this process at the stopping procedure before a bobbin replacement and:

before the bobbin change the spindle speed is reduced to a value between 1500 and 1600 rpm, in a second step the thread guide is raised above the spinning head parallel to the spindle axis by about 20 to 50 mm until a yarn balloon is formed, and after the formation of the yarn balloon, the ring rail is lowered into the underwinding region.

Upon beginning of spinning startup after a bobbin change the spindles initially are driven with a lower speed and the yarn guide remains positioned at the increased distance above the spinning head and the ring rail during the spinning with a yarn balloon is raised from the unwinding position into the spinning startup position on the lower region of the bobbin sleeve, and that after the winding of the first turns on the bobbin the yarn guide is lowered into the working position directly above the spinning head and approximately simultaneously the speed of the spindle is raised to the normal working speed.

In the case of stopping and restarting in which no bobbin replacement is provided, during a planned stopping and starting process the spinning machine is switched over for a period to the spinning process with the yarn balloon.

The apparatus of the invention results in an optimum processing and in addition ensures a greater reliability of the compaction process under the conditions of balloon-reduced spinning. The apparatus comprises a spinning machine with spindles which are each provided with a spindle attachment, with a yarn guide which during the main spinning is located directly above the spindle attachment and which in preparation for a bobbin change is upwardly and laterally swung away, and a drafting frame and supply rollers whose nip is arranged at a distance above the yarn guide and slightly offset from the spindle axis. The supply rollers are arranged at a distance behind the output roller pair of the drafting frame and that the supply rollers of the drafting frame are juxtaposed with a compaction zone (perforated belts suction shoes) for the drafted fiber slubbing.

The yarn guide, for the purpose of altering the spinning process is shiftable parallel to the axis of the spindle and is additionally swingable out of the replacement region of the bobbin, the spindle attachment is fixedly connected with the spindle, and the greatest cross section of the spindle attachment is smaller than the smallest internal diameter of the sleeve.

The configuration of the yarn guide equipped for the purposes of the process change with vertical mobility relative to the spinning head and the swingability from the replacement region of the bobbin enables the latter to be precisely positioned in the working position and to arrange it at a reduced distance from the spinning head and retention of it on bobbin replacement in a noninterfering position.

The exact setting of the distance between yarn guide and spinning head is a precondition for the use of the spinning head with very small cross section. The sleeve can also be moved over the relatively small and low spinning head without the need to remove it for bobbin replacement. The cost of the structure is held low. The time required for the bobbin replacement is reduced.

The yarn guides can be swingable in common by a horizontally oriented vertically shiftable shaft. The shaft can be movable along guides parallel to the axis of the spindle and the last mentioned arrangement can have an independently controllable lifting drive, for example, a motor with a threaded spindle.

With this embodiment it is possible to retrofit the spinning machines of conventional construction with devices for guiding and swinging the thread guide. With lifters independent of the cyclical spinning process, at desired points in time it is possible to match the conditions for process change with a "soft" movement.

BRIEF DESCRIPTION OF THE DRAWING

The invention is described in greater detail with reference to an embodiment. In the associated drawing.

SPECIFIC DESCRIPTION

Figure 1:
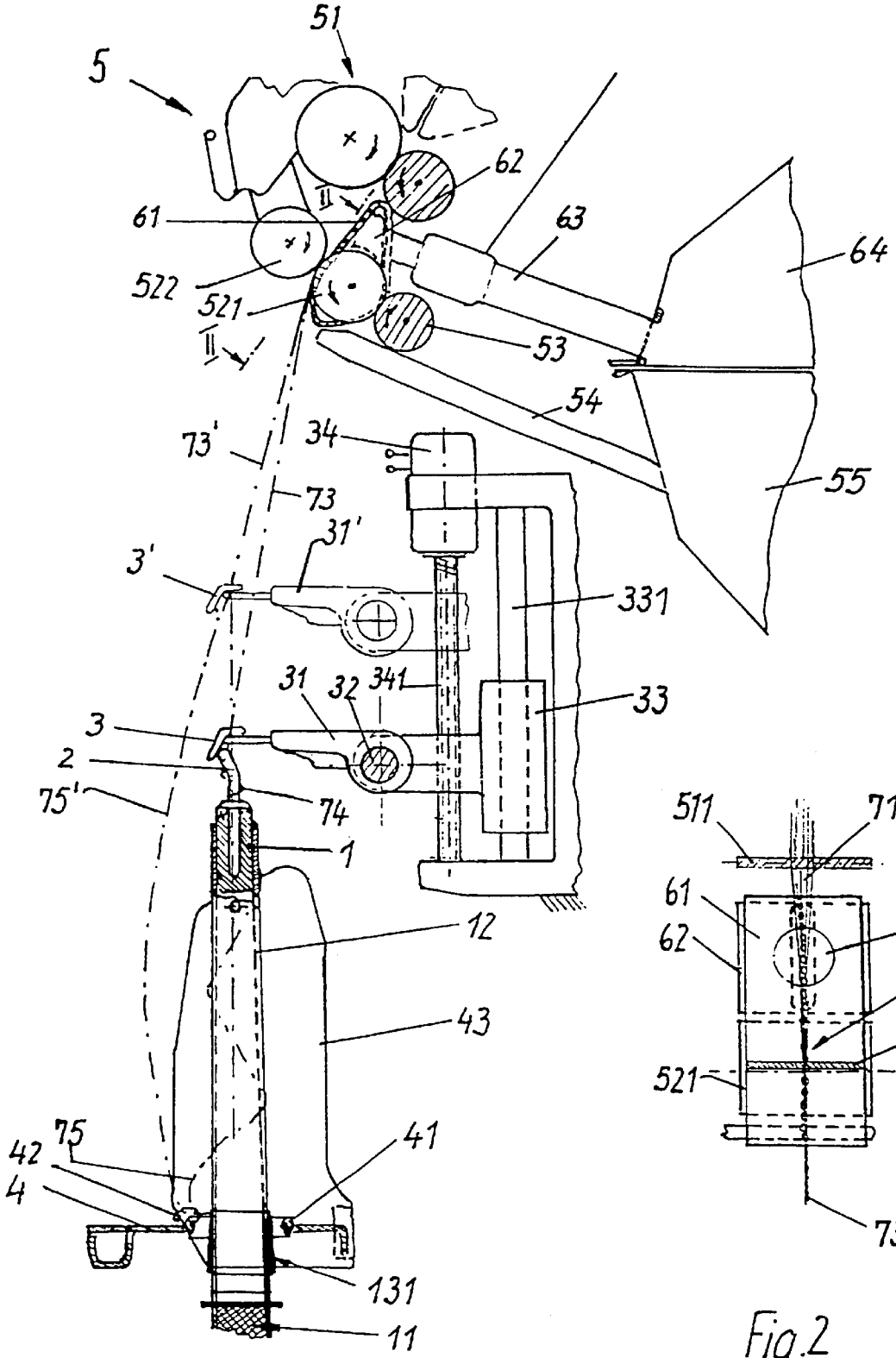
FIG. 1 is a simplified cross section through a spinning zone of a ring-spinning machine.

The ring-spinning machine has in the usual manner a large number of spindles 1. On these spindles 1, so-called spindle attachments 2 are seated from above. In the example illustrated the spindle attachments is a so-called spinning finger. It is possible however to also provide a corresponding spinning crown (compare for example DE 26 53 697 C2).

These spindle attachments 2 are set into corresponding bores of the spindle 1 under prestress. A replacement of these spindle attachments 2 is effected only for the purpose of maintenance. The cross sections of these spindle attachments 2 are so formed that the sleeve 12 or the bobbin 13 can be lifted upwardly over them.

The ring rail 4 is arranged to be raisable and lowerable in the usual sense parallel to the axis of the spindles 1.

The ring rail 4 carries for each spindle 1 a spinning ring 41 on which the ring traveler 42 slides. The ring traveler 42 lays the yarn in the balloon 75 onto the surface of the bobbin 13.

Directly above the spindle attachment 2, during the main spinning, the yarn guide 3 is arranged. This yarn guide 3 is fastened on a pivotal arm 31 which is fixedly connected with the shaft 32. The shaft 32 is pivotal on a lifting slide 33. The lifting slide 33 is arranged in a slide guide 331 fixed on the machine frame. This slide guide 331 is oriented parallel to the axis of the spindle 1.

The lifting slide 33 is driven so as to be vertically movable by the spindles 341. The rotation of the threaded spindle 341 is effected by the motor 34 which receives its control program from a central machine controller. This motor 34 is suitable for displacing the lifting slide 33 with the yarn guide 3 from the position 3 by a stroke or distance 35 exactly into the position 3' and back.

The drafting frame 5 of the ring spinning machine is, in the present case, provided with a compaction unit. This compaction unit is disposed directly downstream of the output roller pair 51 of the drafting frame. A belt 61 perforated along a center line surrounds a suction shoe 62 and a lower feed roller 521.

The lower feed roller 521 which supports the belt 61 from its interior, obtains its drive from a separate drive roller 53 which, as a rule, extends over the entire machine length. The upper feed roller 522 lies in force transmitting relationship on the perforated belt and forms together with this belt, the nip 523.

The operation of this compaction unit is described in patent application DE 197 08 410.9 in detail. For this reason, the mode of operation of this device at this point will not be described in greater detail. Note should be taken only that the suction shoe 62 is connected via a suction pipe 63 with a central suction channel 64. The pressure in this system (62, 63, 64) is independent of the reduced pressure which is generated in suction channel 55 and which is used for the cleaning of certain zones in the region of the spinning machine (for example suction pipe 54).

Figure 2:
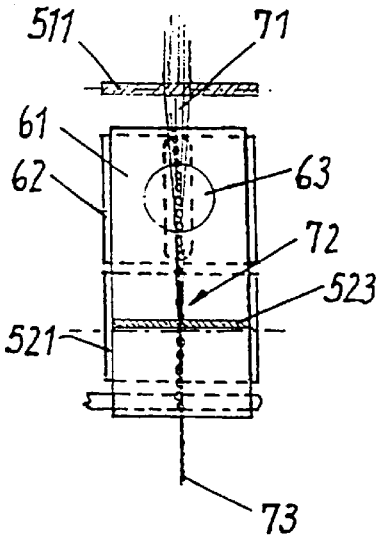
FIG. 2 is a plan view of the compaction zone in the vicinity of the supply roller of a spinning machine in a view along the line II—II of FIG. 1, and FIGS. 3–6 schematic illustrations of the working elements participating in the spinning process in characteristic working positions before and after the bobbin replacement.
Figures 3, 4, 5, 6, 7:
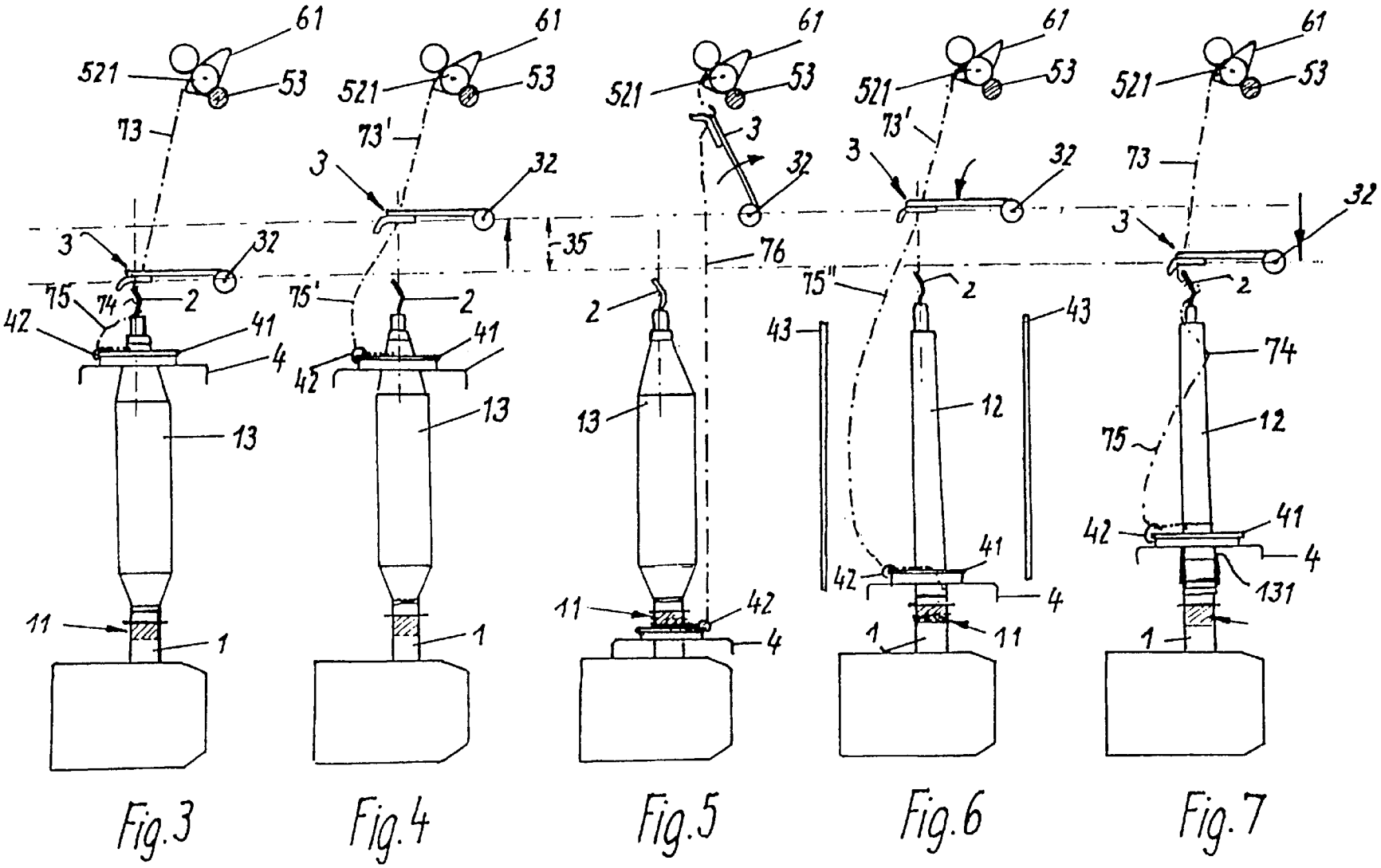

During the main spinning, the illustrated working elements are held in positions as shown in FIG. 3. The finished drafted slubbing 71 is fed through the nip 511 of the output roller pair 51 into the compaction zone (FIG. 2). Via the suction air flow of the suction shoe 62, the individual fibers of the slubbing are gathered and fixed via the holes of the perforation of the belt 61 into a drafted and compacted slubbing 72. This so compacted slubbing 72 passes in this form into the nip 523 of the feed rollers 521, 522.

The twisting applied to the yarn by the effect of the spindle attachment 2 in combination with the thread guide 3 is attained in a short path over the yarn segment 73 from the nip 523. The yarn is so twisted directly at the nip 523 for the compacted slubbing 72, substantially without a spinning triangle so that all fibers are held fixed on one another.

The yarn is practically completely finished at the output of the nip 523 and has the predetermined and necessary high strength.

From the spindle attachment 2 downwardly, the yarn—the yarn segment 74—is guided in at least one turn around the spindle attachment 2, around the upper part of the spindle 1 and optionally around the upper part of the sleeve 12. Relatively close to the plane of movement of the traveller 42, this yarn segment 74 leaves the surface of the sleeve 12 or the spindle and forms a small yarn balloon 75.

This relatively small yarn balloon involves only a limited air resistance a reduced centrifugal force and low yarn tension.

These optimum spinning conditions are usually guaranteed during the normal spinning process (here designated as the main spinning). The strain on the yarn is minimal. There results a yarn which has a uniformity and high strength.

The hairiness of the yarn is low, especially because of the use of the compaction device. The spindle attachment, here configured as a spinning finger, is practically no longer in a position to scrape out fibers from the firm fiber bonding of the yarn and which might negatively influence the quality of the yarn.

When the building of the bobbins 13 is concluded, it is necessary to drop the ring rail 4 rapidly and lay several turns of yarn on the underwinding region 11 of the spindle 1.

Since in this phase, the yarn engaged by the spinning head 2 is not drawn over the full length of the bobbin 13, in the sense of the invention the following steps are carried out:

In a first step, the speed of the spindle is significantly reduced approximately to a value between 2000 and 6000 rpm. When this reduced spindle speed is reached, by a corresponding control command to the motor 34, the yarn guide 3 is moved upwardly parallel to the axis of the spindle 1 by about 30 to 50 mm.

The yarn simultaneously supplied by the feed rollers 521 and 522 thus immediately forms below the raised yarn guide 3' a balloon 75' which lifts the yarn away from the spindle attachment 2.

Through the effect of the traveller 42, the turns around the spindle attachment 2 and the sleeve 12 of the yarn segment 74 are wound up on the bobbin 13. The spinning machine then works in accordance with usual spinning processes with a yarn balloon 75' (FIG. 4).

If the yarn balloon 75' is built properly, the ring rail 4 can be moved in the usual manner into the underwinding position (FIG. 5). Thus all of the processes run in the same way as in a spinning machine which works with a yarn balloon. The reduced spinning speed which has been referred to above should be so chosen that the diameter of the resulting yarn balloon 75' or 75" is smaller than the lateral spacing between two balloon separating plates 43 which are arranged between neighboring spindles 1.

When the ring rail reaches the underwinding position (FIG. 5) the yarn guide 3 is swung away upwardly. The yarn 76 is tensioned between the yarn guide 3 and the traveller 42 in the stopped spinning machine such that it does not prevent replacement of the bobbin 13 by a new sleeve 12. When the bobbin replacement process is concluded, the yarn guide 3, initially in its upper working position approximately at a distance 35 above the spindle attachment 2, is swung back (FIG. 6).

When the yarn guide 3' has reached this position, the spindle 1 begins to move with a relatively reduced speed. The thus resulting yarn balloon 75" has a diameter which is so small that it can move substantially collision free between the balloon separating plates 43.

In this phase the ring rail 4 moves to the level of the lower bobbin edge and begins to wind the bobbin attachment 131. At this point in time, the yarn guide 3 is moved by the distance 35 again in the direction of the spindle attachment 2. As soon as the yarn segment 75" emerging from below the thread guide is engaged by the spindle attachment 2, the spinning process with suppressed yarn balloon 75 begins again (FIG. 7).

The yarn segment 74 engaged by the spindle attachment 2 winds then one or more times around the shaft of the spindle attachment 2 and around the upper section of the sleeve 12. The relatively small thread tension in the yarn balloon 75 is transferred to a limited extent to the yarn segment 73. The spinning process can again proceed with optimum conditions.

The above process, has been described here in combination with the bobbin change. It is possible to vary this process between spinning with a balloon and spinning with suppressed yarn balloon with reduced speed also when the ring spinning machine for various reasons should be shut down. In this case, initially the spindle speed is reduced and the yarn guide 3 raised. The ring rail remains in its previous position. The machine is brought to a standstill.

If the machine is to be returned to operation, initially the spindles rotate with reduced speed. When a normal small yarn balloon 75" is formed, the yarn guide 3 is lowered into its working position and the spinning with a reduced yarn balloon 75 proceeds again.

The advantage of the method of the invention resides in that, in all phases during the normal spinning process and during start up and shut down of the machine, respective optimum conditions are effective for the yarn to be spun. Of special significance is the combination of spinning with reduced yarn balloon and the use of a compaction device for drafted slubbing at the output of the drafting frame. As has already been described at the outset, this combination gives rise to the twisting of all fibers with one another directly at the outlet of the nip 523 between the perforated belt 61 and the upper feed roller 522.

The number of yarn breaks in this critical region is reduced even with usual spindle speeds.

If one takes the usual yarn break count as a given, one can increase the speed of the spindle during the main spinning substantially by an order of magnitude.

A further disadvantage of this combination is that the reduced hairiness of the yarn which is obtained immediately downstream of the nip 523 is not altered in the region of the spindle attachment 2 and by the passage of the yarn onto the bobbin sleeve 12. Tests have shown that the yarn spun with the aforementioned combination is less hairy than the yarn spun without the compaction device and without the spindle attachment.

The startup of the spinning after a bobbin change is effected during the spinning process with a yarn balloon 75" and is substantially more reliable. The fiber in tension between the traveller 42 and the yarn guide 3 is passed at a greater distance from the toothed disk between the unwinding region and the lower most edge of the sleeve 12. If one operates with a suppressed yarn balloon 75 in this phase it cannot be excluded that the fiber will be cut by this toothed disk.

What is claimed is:

1. A method of spinning which comprises the steps of:

(a) drafting a slubbing by passing said slubbing through a drafting frame having rollers at an output side of said drafting frame defining a nip engaging the drafted slubbing;

(b) subjecting drafted slubbing in said drafting frame to compaction immediately upstream of said nip by passing the drafted slubbing over a row of perforations under suction to draw fibers inwardly and compact the drafted slubbing entering said nip;

(c) passing a compacted drafted slubbing emerging from said nip through a vertically shiftable thread guide positioned axially above a spindle carrying a bobbin sleeve on which a spun thread is to be wound;

(d) in a lower position of said thread guide, engaging the compacted drafted slubbing with a balloon-suppressing attachment extending upwardly from said spindle to twist the compacted drafted slubbing between said attachment and said nip substantially without a thread triangle at said nip to form a thread and guide said thread onto said bobbin sleeve through a traveler on a vertically movable ring rail to wind a bobbin thereon with a suppressed thread balloon; and (e) preparatory to bobbin change, displacing said thread guide upwardly to disengage said thread from said attachment and lowering said ring rail to an underwinding portion of said spindle.

2. The method defined in claim 1, further comprising the steps of:

in preparation for stopping a spinning machine provided with said spindle, reducing a speed of said spindle by more than 50%, with said spindle at a reduced speed, increasing a spacing between said thread guide and said attachment and transforming spinning is from spinning with a suppressed balloon to balloon-type spinning;

for restarting of the spinning machine the increased spacing between said thread guide and the attachment is maintained, at a low spindle speed and during a spinning process with a thread balloon, initial turns are applied to the bobbin sleeve, and the thread guide is then lowered toward the attachment for engagement of the attachment with the thread for spinning with the suppressed thread balloon.

3. The method defined in claim 2 wherein prior to bobbin change a speed of said spindle is reduced to a value between 1500 and 1600 rpm, the thread guide is raised above said attachment by about 20 to 50 mm until a thread balloon is formed and after formation of the thread balloon, said ring rail is lowered to the unwinding portion of said spindle.

4. The method defined in claim 1 wherein, upon spinning starting up after a bobbin change the method comprises the steps of driving the spindle with a reduced speed and maintaining said thread guide positioned at an increased distance above said attachment, and while spinning with a thread balloon, raising said ring rail into a spinning start up position at a lowered region of the bobbin sleeve, and, after winding of initial turns on the bobbin sleeve, lowering the yarn guide into said lower positions and raising the speed of the spindle to a normal speed for spinning with a suppressing thread balloon.

5. The method defined in claim 1 further comprising the step of raising said thread guide to switch over between operation with said suppressed thread balloon during planned stopping and starting of a machine provided with the spindle.

6. A spinning machine comprising:

a drafting frame for drafting at least one slubbing and having rollers at an output side of said drafting frame defining a nip engaging the drafted slubbing;

a slubbing compactor in said drafting frame immediately upstream of said nip for subjecting drafted slubbing in said drafting frame to compaction and including a row of perforations under suction for drawing fiber inwardly of stubbing passing over the row of perforations to compact the drafted slubbing entering said nip;

a vertically shiftable thread guide receiving compacted drafting stubbing emerging from said nip;

a spindle disposed below said thread guide and carrying a bobbin sleeve on which a thread spun from the compacted drafted slubbing is to be wound; and a balloon suppressing attachment extending upwardly from said spindle and engaging the compacted drafting slubbing to twist the compacted drafting slubbing between said attachment and said nip substantially without a thread triangle at said nip to form a thread and guide said thread onto said bobbin sleeve through a traveler on a vertically movable ring rail to wind a bobbin on said sleeve with a suppressed thread balloon, said thread guide being located directly above said attachment for spinning and being outwardly movable and laterally swingable away from a position above said attachment for said bobbin change, said drafting frame including rollers spaced upstream from the rollers at the output side of said drafting frame and forming a compaction zone provided with perforated belts and suction shoes.

7. The spinning machine defined in claim 6 wherein said attachment is fixed to said spindle and a largest cross section of the attachment is smaller than the smallest internal diameter of said sleeve.

8. The spinning machine defined in claim 6 wherein a plurality of said yarn guides are swingable in common by a horizontally oriented vertically shiftable shaft said shaft being movable along guides parallel to the axis of the spindle, a motor with a threaded spindle being connected to said shaft for shifting same.

* * * * *

UNITED STATES PATENT AND TRADEMARK OFFICE

CERTIFICATE OF CORRECTION

PATENT NO. : 6,332,312 B1
DATED : December 25, 2001
INVENTOR(S) : Rainer Löscher It is certified that error appears in the above-identified patent and that said Letters Patent is hereby corrected as shown below:

Title page,
Item "[22], PCT filed: Sep. 30, 1999" should read: -- [22] PCT filed: Mar. 26, 1999 --
.

Signed and Sealed this

Fourth Day of June, 2002

*Attest:*

*Attesting Officer*

JAMES E. ROGAN
*Director of the United States Patent and Trademark Office*